US008659494B2

(12) United States Patent
Bellows

(10) Patent No.: US 8,659,494 B2
(45) Date of Patent: Feb. 25, 2014

(54) ROTATING-POLARIZATION REFLECTOR-BACKED RFID LOOP ANTENNA APPARATUS AND METHOD

(75) Inventor: David E. Bellows, Wantagh, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 294 days.

(21) Appl. No.: 13/290,160

(22) Filed: Nov. 7, 2011

(65) Prior Publication Data

US 2013/0113669 A1 May 9, 2013

(51) Int. Cl.
*H01Q 3/00* (2006.01)

(52) U.S. Cl.
USPC ..... 343/764; 340/572.1

(58) Field of Classification Search
USPC ..... 343/741, 866, 761, 764; 340/572.1
See application file for complete search history.

(56) References Cited

U.S. PATENT DOCUMENTS

| | | | | |
|---|---|---|---|---|
| 7,421,245 | B2 | 9/2008 | Lieffort et al. | |
| 7,439,926 | B2 | 10/2008 | Mikami et al. | |
| 7,825,802 | B2 * | 11/2010 | Baiker et al. | 340/572.1 |
| 8,165,552 | B2 * | 4/2012 | Rofougaran et al. | 455/274 |
| 2010/0277386 | A1 | 11/2010 | Iliev et al. | |

* cited by examiner

*Primary Examiner* — Tan Ho

(57) ABSTRACT

The present disclosure provides a rotating-polarization reflector-backed Radio Frequency Identification (RFID) loop antenna apparatus and method. The loop antenna apparatus and method provides high gain (i.e., maximizing read distances at lowest power), directionality (i.e., ability to focus on specific areas), orientation insensitivity (i.e., ability to read RFID tags in any direction or orientation) while occupying minimal volume in overhead configurations. In an exemplary embodiment, the loop antenna apparatus includes a reflector and a loop element with the reflector configured to reflect downward RF energy from the loop element. Antenna polarization is controlled by a feed location on the loop element and antenna pattern is controlled by the reflector. Thus, orientation insensitivity may be achieved without changing the antenna pattern by rotating the feed location and not the reflector.

20 Claims, 7 Drawing Sheets

ROTATING-POLARIZATION REFLECTOR-BACKED RFID LOOP ANTENNA APPARATUS AND METHOD

FIELD OF THE DISCLOSURE

The present disclosure relates generally to wireless antennas and more particularly to a rotating-polarization reflector-backed Radio Frequency Identification (RFID) loop antenna apparatus and method.

BACKGROUND

Radio Frequency Identification (RFID) is utilized in a variety of applications with RFID readers communicating with RFID tags for purposes of identification, location, tracking, and the like. In an exemplary RFID application, an RFID reader may be mounted overhead (e.g., ceiling mounted) relative to a plurality of RFID tags. For example, in a retail, warehouse, etc. scenario, the RFID reader may be mounted above the RFID tags and their associated objects. Conventional antenna designs may be utilized in overhead configurations but with disadvantages. For example, a Yagi antenna may be utilized in the RFID reader but requires a certain amount of length hanging down from the overhead location. Additionally, a phased antenna array could also be used in the RFID reader, but such a solution requires electronic beam steering, adding complexity and cost. Alternatively, a chandelier antenna system (i.e., a series of antennas arranged in a circle collectively resembling a chandelier) could also be used in the RFID reader, but this may also require additional cost and size.

Accordingly, there is a need for an RFID antenna apparatus and method overcoming the aforementioned limitations and providing high gain, directionality, and orientation insensitivity while occupying minimal volume in overhead configurations.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
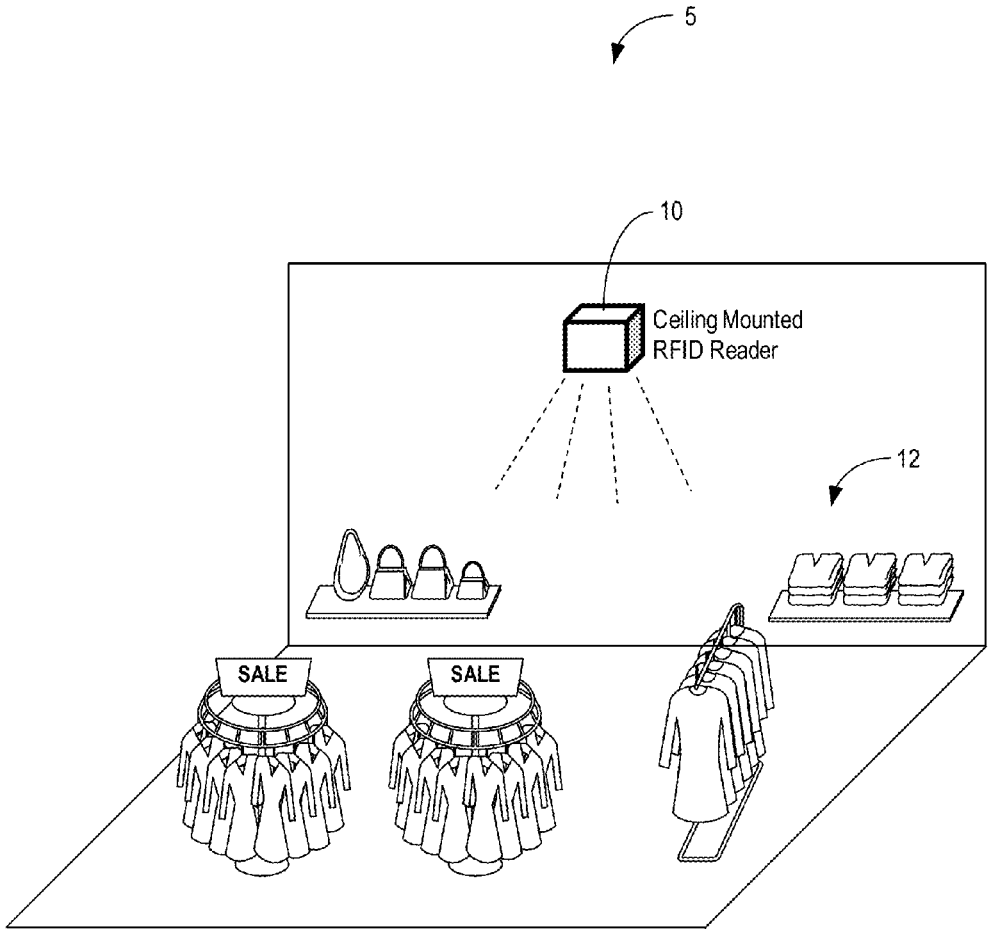
FIG. 1 is a perspective diagram of an environment utilizing an RFID reader in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

In various exemplary embodiments, the present disclosure provides a rotating-polarization reflector-backed Radio Frequency Identification (RFID) loop antenna apparatus and method. Advantageously, the loop antenna apparatus and method provides high gain (i.e., maximizing read distances at lowest power), directionality (i.e., ability to focus on specific areas), orientation insensitivity (i.e., (i.e., ability to read RFID tags in any direction or orientation) while occupying minimal volume in overhead configurations.

In an exemplary embodiment, an antenna apparatus includes a rotatable loop element with a feed and a reflector backing the loop element and configured to reflect radio frequency energy from the loop element in a direction substantially perpendicular to the reflector. The rotatable loop element and the reflector cooperatively form a rotating-polarization reflector-backed loop antenna with directionality responsive to a position and/or orientation of the reflector and polarization responsive to a position of the feed on the rotatable loop element. The rotatable loop element may be configured to rotate by at least 90 degrees thereby providing vertical and horizontal polarization coverage with the rotatable loop element.

The rotatable loop element may include a circumference dimensioned responsive to approximately one full wavelength and the reflector may include a diameter dimensioned responsive to approximately one full wavelength. A pattern formed by the rotating-polarization reflector-backed loop antenna is based on the reflector. The rotating-polarization reflector-backed loop antenna may be rotated for spatial diversity and the rotatable loop element may be rotated without rotating the reflector for polarization diversity. Note, the rotatable loop element and the reflector are illustrated herein in a substantially circular shape, but those of ordinary skill in the art will recognize other shapes are also contemplated. Further, note that small holes may be included in the reflector.

The antenna apparatus may further include a housing including the rotatable loop element and disposed to the reflector. The housing may include a substantially dome shape with the rotatable loop element formed on, disposed to, or attached on the dome shape. The housing may be configured to rotate the rotatable loop element thereby providing vertical and horizontal polarization coverage with the rotatable loop element. The antenna apparatus may further include an RFID reader disposed in the housing and communicatively coupled to the rotating-polarization reflector-backed loop antenna. The antenna apparatus may further include a device with any of a camera and wireless access point disposed in the housing and located substantially within a center of the rotatable loop element. Additionally, the RFID reader may also be located behind the reflector, not just in the housing that is coupled to the antenna. Similarly, the access point may also be behind the reflector.

In another exemplary embodiment, an RFID reader includes a housing, an RFID reader module disposed in the housing, and a rotating-polarization reflector-backed loop antenna communicatively coupled to the RFID reader module. The RFID reader is configured to operate in an overhead configuration with respect to a plurality of RFID tags based on the rotating-polarization reflector-backed loop antenna. The rotating-polarization reflector-backed loop antenna may include a rotatable loop element with a feed and a reflector backing the loop element and configured to reflect radio frequency energy from the loop element in a direction substantially perpendicular to the reflector. The rotatable loop element and the reflector cooperatively form the rotating-polarization reflector-backed loop antenna with directionality responsive to a position and/or orientation of the reflector and polarization responsive to a position of the feed on the rotatable loop element.

The rotatable loop element may be configured to rotate by at least 90 degrees thereby providing vertical and horizontal polarization coverage with the rotatable loop element. The rotatable loop element may include a circumference dimensioned responsive to approximately one full wavelength and the reflector may include a diameter dimensioned responsive to approximately one full wavelength. A pattern formed by the rotating-polarization reflector-backed loop antenna is based on the reflector. The rotating-polarization reflector-backed loop antenna may be rotated for spatial diversity and the rotatable loop element may be rotated without rotating the reflector for polarization diversity.

The housing may include a substantially dome shape with the rotatable loop element formed on, disposed to, or attached on the dome shape. The housing may be configured to rotate the rotatable loop element thereby providing vertical and horizontal polarization coverage with the rotatable loop element. The RFID reader may further include a device including any of a camera and wireless access point disposed in the housing and located substantially within a center of the rotatable loop element. Additionally, the RFID reader may also be located behind the reflector, not just in the housing that is coupled to the antenna. Similarly, the access point may also be behind the reflector.

In yet another exemplary embodiment, a method includes transmitting radio frequency energy using a loop element with a feed in a first position, reflecting with a reflector substantially all of the radio frequency transmitted from the loop element in a vertical direction, rotating the feed while keeping the reflector in a same position to achieve polarization diversity, and rotating the reflector and the loop element with the field cooperatively to achieve spatial diversity. In particular, rotating the feed while keeping the reflector in a same position changes the antenna polarization without changing the field pattern.

As RFID matures, ceiling-mounted RFID readers that passively read RFID tags is a logical next step of this technology's evolution. Since RFID is a passive technology, overhead RFID readers that do not require human operation are a next logical improvement over conventional handheld RFID readers that have become more prevalent. To address this need, an antenna for the ceiling mounted overhead RFID reader needs to be designed. Such an antenna requires a high gain, directional, orientation insensitive RFID antenna that occupies minimal volume. High gain (e.g., 6 dB) is needed to maximize read range while keeping required power relatively low. Directionality allows the antenna to focus on reading specific areas of a physical environment. Orientation insensitivity is needed so the antenna can read RFID tags orientated in any manner (e.g., horizontal vs. vertical polarization), and physical size needs to be kept to a minimum so that the system is unobtrusive, easy to integrate, and allows for other features, such as a security camera, access point electronics, etc.

FIG. 1 is a perspective diagram of an exemplary retail environment 5 with an RFID reader 10 using a rotating-polarization reflector-backed RFID loop antenna in an overhead configuration. In particular, the RFID reader 10 is configured to wirelessly interrogate a plurality of RFID tags located on or affixed to a plurality of items 12. The RFID reader 10 may be mounted to a ceiling in the retail environment. The retail environment 5 is shown solely for illustration purposes, and the rotating-polarization reflector-backed RFID loop antenna may be used in any environment including warehouse, manufacturing facility, file room, storage area, and the like. The overhead configuration is one in which the RFID reader 10 is configured to read RFID tags that are physically below the RFID reader 10 from a vertical perspective.

The overhead configuration offers several advantages such as fewer physical obstructions, ease of access to wiring in a ceiling, tamper resistance, safety, and the like. Additionally, the RFID reader 10 may include an integrated housing for the rotating-polarization reflector-backed RFID loop antenna and associated electronics for providing RFID reader functionality. The RFID reader 10 may further include a light source, a wireless access point (e.g., compliant to IEEE 802.11 and variants thereof), a surveillance device (e.g., a camera), and the like. Additionally, the RFID reader may include other wireless technologies such as, but are not limited to: RF; IrDA (infrared); Bluetooth; ZigBee (and other variants of the IEEE 802.15 protocol); IEEE 802.11 (any variation); IEEE 802.16 (WiMAX or any other variation); Universal Mobile Telecommunications System (UMTS); Code Division Multiple Access (CDMA) including all variants; Global System for Mobile Communications (GSM) and all variants; Time division multiple access (TDMA) and all variants; Direct Sequence Spread Spectrum; Frequency Hopping Spread Spectrum; wireless/cordless telecommunication protocols; wireless home network communication protocols; paging network protocols; magnetic induction; satellite data communication protocols; wireless hospital or health care facility network protocols such as those operating in the WMTS bands; GPRS; and proprietary wireless data communication protocols such as variants of Wireless USB.

Figure 2:
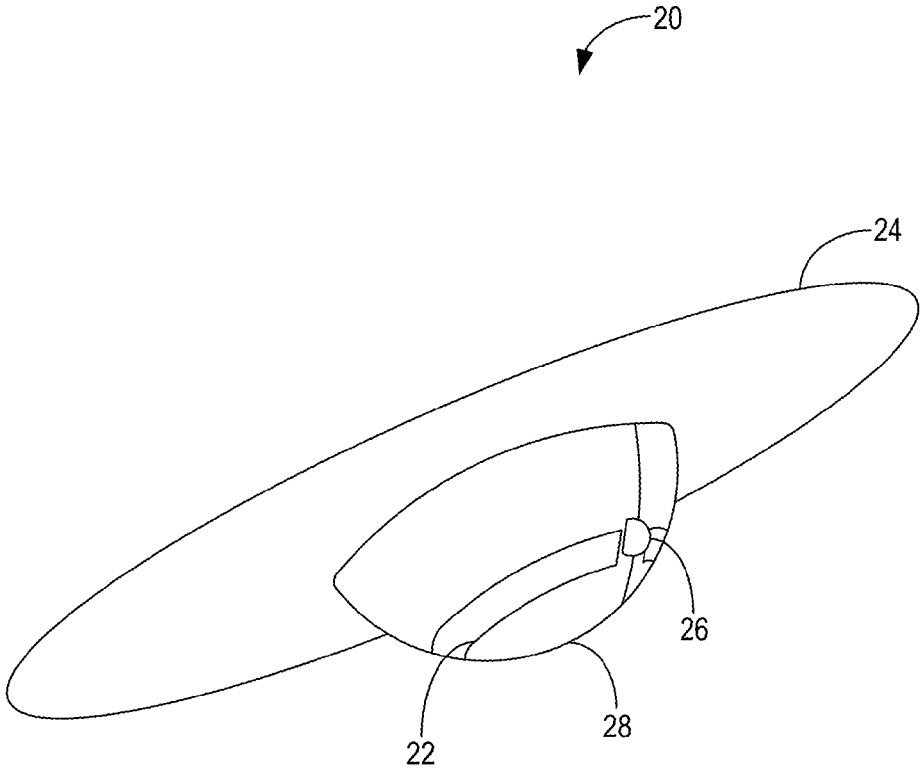
FIG. 2 is a perspective diagram of a rotating-polarization reflector-backed RFID loop antenna in accordance with some embodiments.

FIG. 2 is a perspective diagram of a rotating-polarization reflector-backed RFID loop antenna 20 which may be utilized in the overhead configuration and with the RFID reader 10. The rotating-polarization reflector-backed RFID loop antenna 20 trades length (i.e., height from a ceiling) for footprint, resulting in a more compact, unobtrusive design that can be integrated into a larger system (e.g., with a security camera, access point electronics, etc.) more easily. The antenna 20 includes a loop element 22 and a reflector 24. The loop element 22 includes a feed 26 and is physically associated with a housing 28. For example, the housing 28 may include a dome structure with the loop element 22 and the feed 26 attached thereto, disposed thereon, integrally formed, etc. The housing 28 physically provides a distance between the loop element 22 and the reflector 24.

The housing 28 may further include electronics and RF components for operation of the loop antenna 20. For example, the electronics and components may include electrical connectivity to the feed 26 for transmission and reception of radio frequency signals from the loop element 22. The housing 28 may further include electronics and the like for operation of the RFID reader as well as other components as described herein. The housing 28 may be attached or disposed to the reflector 24. In an exemplary embodiment, a camera or the like may be disposed within the housing pointed outwards through the loop element 22, i.e. the loop element 22 includes an open space for various components in the housing 28. Alternatively, the electronics, components, etc. may be disposed or located behind the reflector 24.

The antenna 20 includes the loop element 22 which is a full wavelength loop antenna backed by the reflector 24 which is a full wavelength diameter reflector that directs all the radiated energy in one direction, resulting in a high gain, directional antenna in a short form factor. The loop element 22 minimizes a length of the high-gain, directional antenna 20 that is required for the overhead RFID reader 10. The loop element 22 may include a conductive strip arranged substantially in a circle having a circumference of approximately one wavelength to form an active element. For example, the loop element 22 may include a circumference of approximately 12.9 inches at 915 MHz which is a standard frequency for RFID applications. Also, the reflector 24 may include a diameter of approximately 12.9 inches at 915 MHz. Additionally, the loop element 22, the reflector 24, etc. are illustrated herein with a circular shape, but those of ordinary skill in the art will recognize other shapes are also contemplated. Further, the reflector 24 may include holes disposed therein.

Figure 3:
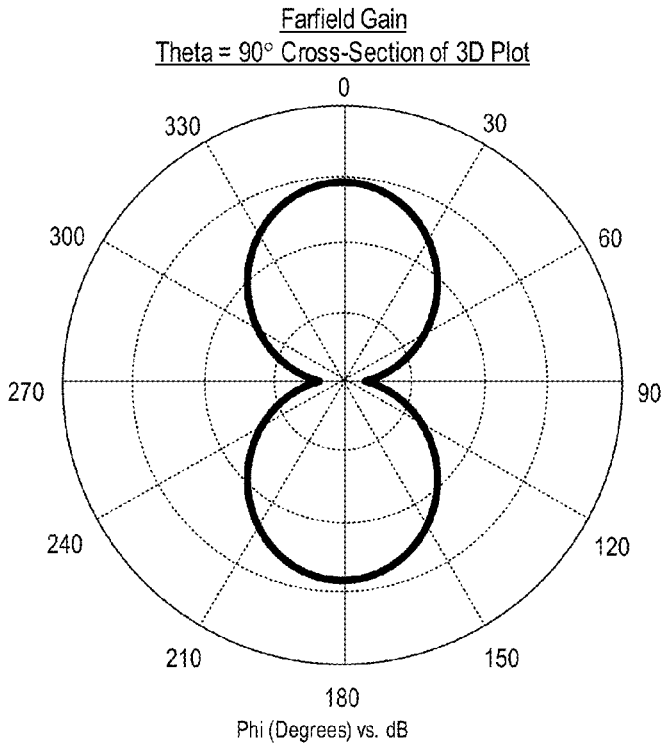
FIG. 3 is a cross-sectional plot of the far field gain in a vertical direction solely with a loop element.

FIG. 3 is a cross-sectional plot of the far field gain in a vertical direction solely with the loop element 22 and no reflector 24. With only the loop element 22, half of the RF energy radiates perpendicular to the conductive strip in one direction, and the other half radiates in the opposite direction. A null exists to each side. For the ceiling mounted RFID reader 10, only half of this energy is useful since anything radiated up into the ceiling serves no purpose; the RFID tags to be read are below the RFID reader 10 in the overhead configuration.

Figure 4:
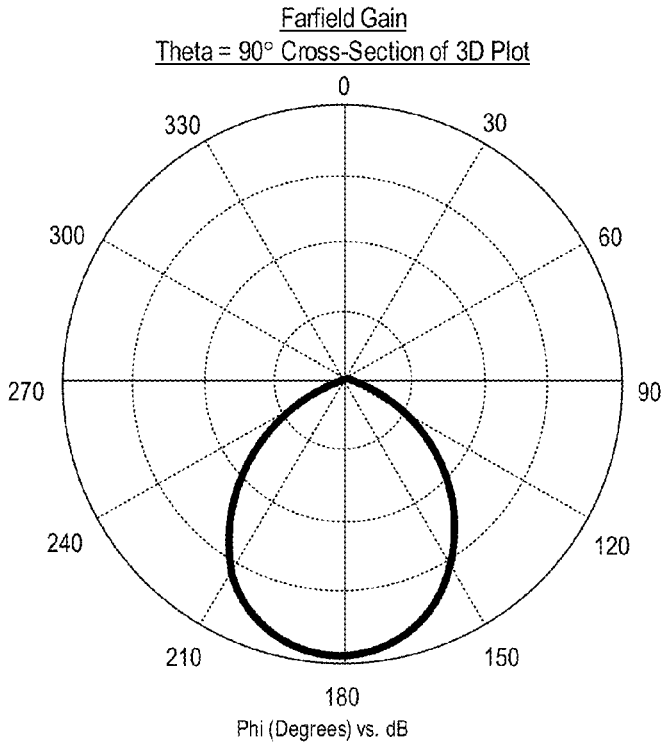
FIG. 4 is a cross-sectional plot of the far field gain in a vertical direction with a loop element and a reflector in accordance with some embodiments.

The reflector 24 is a conductive plate (reflector) with a diameter of approximately one wavelength that is added behind the loop element 22. The reflector 24 takes the energy that was directed up and redirects it downward perpendicular to the reflector 24, combining it with the other half of the pattern that was already directed downward. The result is a high gain, directional antenna. In particular, FIG. 4 is a cross-sectional plot of the far field gain in a vertical direction with the loop element 22 and the reflector 24 disposed to the loop element 24. Note, the plots in FIGS. 3 and 4 are with the loop element 22 and the reflector 24 directed in a downward direction to 180 deg., i.e. without any angular tilt. The perspective diagram of FIG. 2 illustrates the antenna 20 with a slight angular tilt. For example, the antenna 20 of FIG. 2 would slightly adjust the plot of FIG. 4 such that the gain was directed to about 150 deg. instead of 180 deg.

Figure 5:
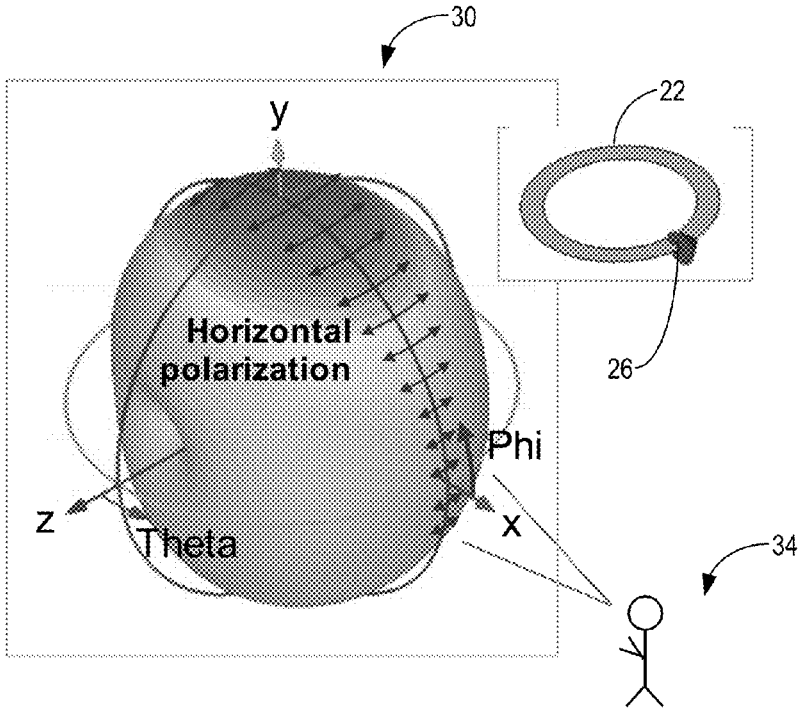
FIG. 5 is a 3D plot of the far field gain in a horizontal polarization solely with a loop element.
Figure 6:
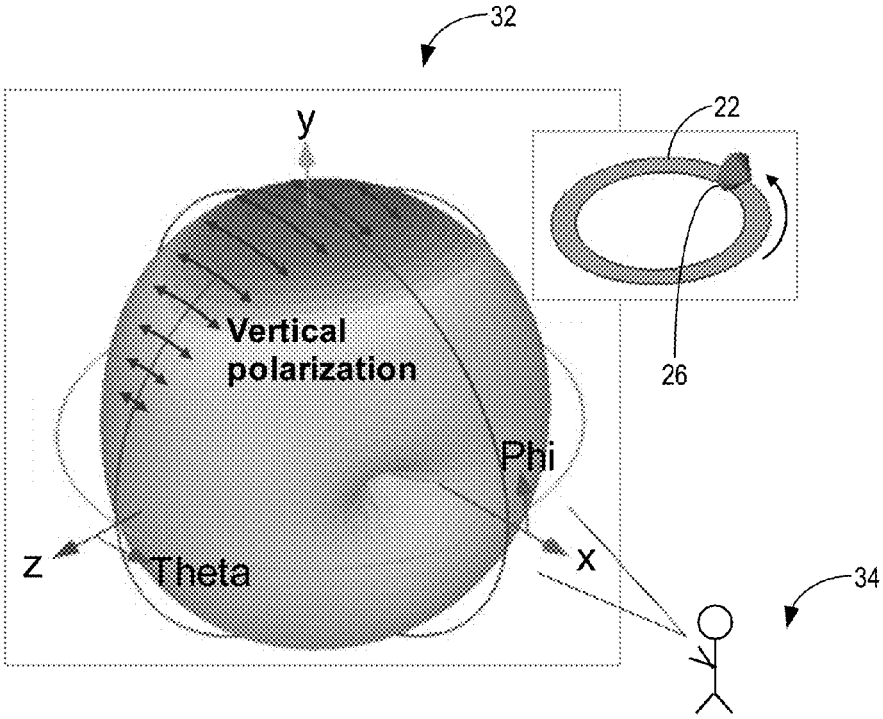
FIG. 6 is a 3D plot of the far field gain in a vertical polarization solely with a loop element.

It is necessary to be capable of reading orthogonal polarizations so tags in any orientation can be read. A static loop element is linearly polarized and will provide only a single polarization. FIGS. 5 and 6 are 3D plots of far field gain showing horizontal polarization 30 and vertical polarization 32 relative to a user 34 for the loop element 22 with no reflector. The polarization of the loop element 22 is dictated by the feed 26 location. If the loop element 22 is a circle fed at the bottom (on the x-axis of the 3D plot) such as shown in FIG. 5, the loop element 22 is a horizontally polarized antenna. If the loop element 22 is a circle fed at the side (on the z-axis of the 3D plot) such as shown in FIG. 6, the loop element 22 is a vertically polarized antenna. Thus, if the loop element 22 and the feed 26 are rotated 90 degrees, the polarization changes. However, for the loop element 22 by itself (i.e., without the reflector 24), the pattern will rotate along with the rotation of the loop element 22 itself. That is, the user 34 does not move and sees a rotated pattern between FIGS. 5 and 6. This is not desirable since the objective is to achieve 100% pattern coverage with both polarizations; if the pattern changes, then the coverage area changes as well.

When the reflector 24 is added however, the pattern does not change as the loop element 22 is rotated. Rather, only the polarization changes. Thus, the polarization is controlled by the feed 26 location on the loop element 22, and the pattern is controlled by the reflector 24. In other words, rotate the loop element 22 for polarization diversity, and rotate the entire structure for spatial diversity. This is an important technical aspect of the antenna 20, namely the polarization is controlled by the feed 26 location and the pattern is controlled by the reflector 24. Note the polarization of the antenna pattern is linearly polarized, meaning that any RFID tag with orthogonal polarization will not be energized by the antenna 20. However, the loop element 22 may be configured to rotate 90 degrees to provide both horizontal and vertical polarization without any changes to the pattern.

The loop element 22 may be rotated about an axis perpendicular to the reflector 24 (but note that the invention is not limited to this axis of rotation). By rotating about an axis perpendicular to the reflector 24, a constant distance between the loop element 22 and reflector 24 is maintained for all loop orientations, resulting in consistent RF performance.

Figure 7:
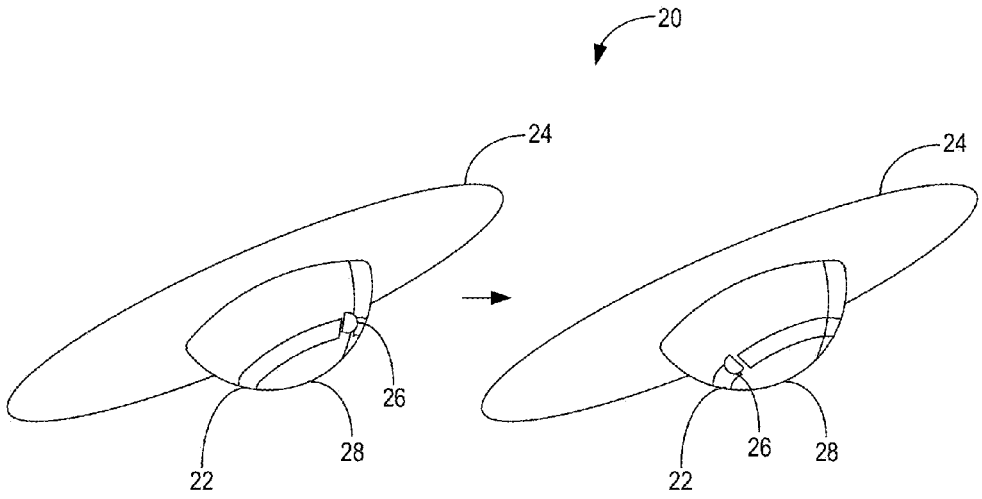
FIG. 7 is a perspective diagram of a rotating-polarization reflector-backed RFID loop antenna with rotation in a loop element in accordance with some embodiments.
Figure 8:
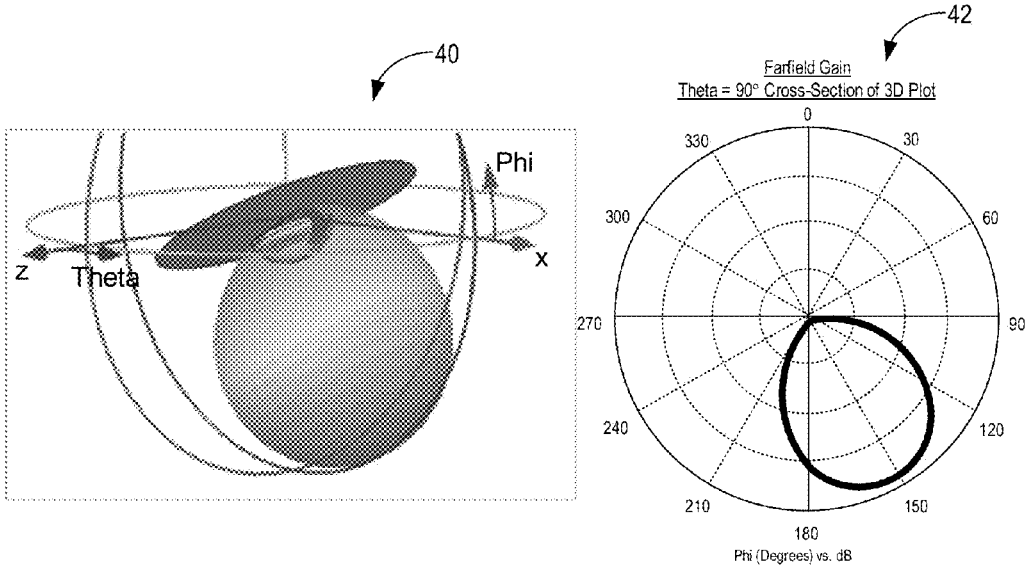
FIG. 8 is a 3D plot and a cross-sectional plot of the far field gain for the antenna of FIG. 7 in accordance with some embodiments.

FIG. 7 is a diagram of the antenna 20 with rotation on the loop element 22 and FIG. 8 is an associated 3D far field gain plot 40 and cross-sectional far field gain plot 42 of the antenna of FIG. 7. As described above, in essence, the polarization of the antenna 20 is controlled by the loop's feed location, and the pattern is controlled by the reflector 24. Thus, the antenna 20 may achieve orientation insensitivity through manipulation of the feed 26 location on the loop element. For example, the feed 26 may be movable through rotation of the housing 28 by 90 deg. as shown in FIG. 7. The housing 28 may include a motor disposed therein for providing the rotation. Also, the loop element 22 itself may be physically rotated with the housing 28 being stationary. Additionally, the loop element 22 may be formed with plural feed locations that are alternately used to provide orientation insensitive coverage. The plots 40 and 42 in FIG. 8 are applicable to both configurations of the antenna 20 shown in FIG. 7. In other words, the antenna pattern is the same for both polarizations The antenna 20 has a directed pattern with the reflector 24 directing all of the RF energy downward, perpendicular to the reflector 24. Advantageously, substantially no RF energy is wasted with the antenna 20 being high gain, directional in nature. Specifically, rotation of the loop element 22 and the associated feed 26 (via rotating the loop element 22 and the feed 26 or the entire housing 28, and not rotating the reflector 24) results in polarization diversity. Rotation of the entire antenna 20 structure, i.e. the loop element 22 and the reflector 24 and associated components, results in spatial diversity. That is, the pattern may be structure aimed/directed to wherever it is desired based on how the entire antenna 20 structure is oriented.

The entire antenna 20 structure may be rotated for spatial diversity. This rotation may be about any axis. For example, rotating about an axis perpendicular to a ceiling will sweep the pattern around a floor below in a circle. The circular swept pattern results from the detail that the antenna 20 is not parallel to the ceiling. For example, in the embodiment shown in FIG. 7, the antenna 20 is angled about 30 degrees. Furthermore, rotating about an axis parallel to ceiling beams will sweep the pattern in elevation through the space below. The invention is not limited to these exemplary embodiments. Also note that the rotation axis does not have to intersect the phase center of the antenna 20.

Figure 9:
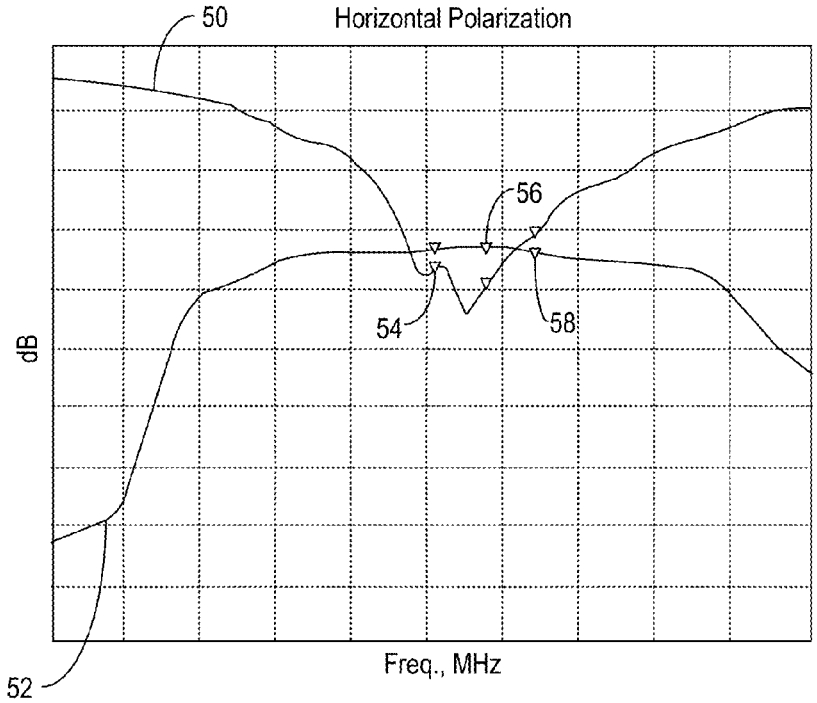
FIG. 9 is a plot of return loss and gain for the antenna of FIG. 7 in a horizontal polarization in accordance with some embodiments.
Figure 10:
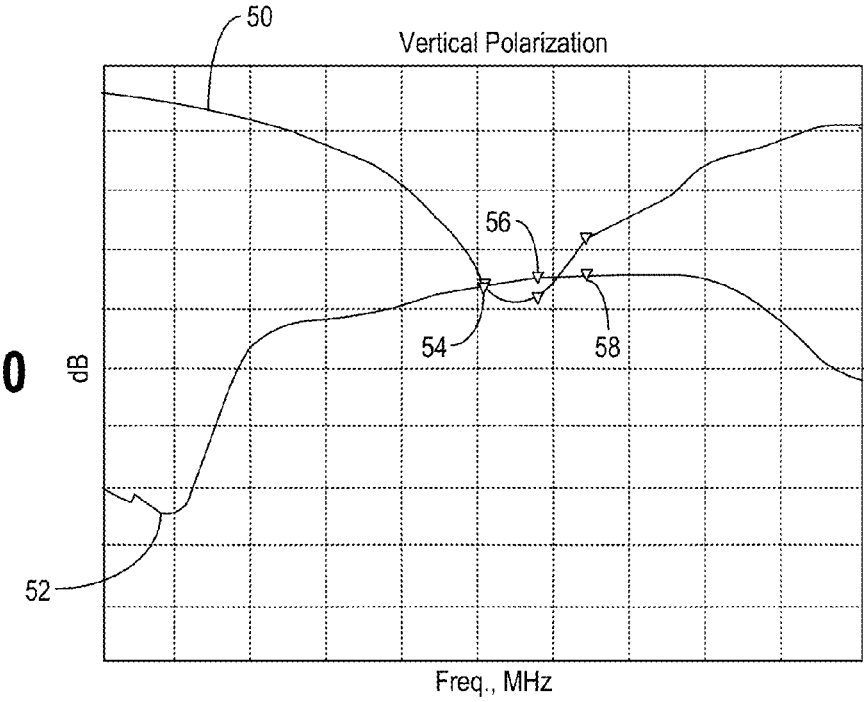
FIG. 10 is a plot of return loss and gain for the antenna of FIG. 7 in a vertical polarization in accordance with some embodiments.

FIGS. 9 and 10 are plots of physical measurements of return loss 50 and gain 52 for horizontal (FIG. 9) and vertical (FIG. 10) polarizations. Each of the return loss 50 and the gain 52 include specific data points 54, 56, 58 at 902 MHz, 915 MHz, and 928 MHz. These frequencies are common frequencies used in RFID applications. Numerous RF simulations were run and physical RF mockups were built, and the testing validates the concepts associated with the antenna 20. Gain, return loss, and pattern were all confirmed. In particular, the return loss 50 is minus 15 dB or below in the desired frequency ranges and the gain is 7-8 dB.

Figure 11:
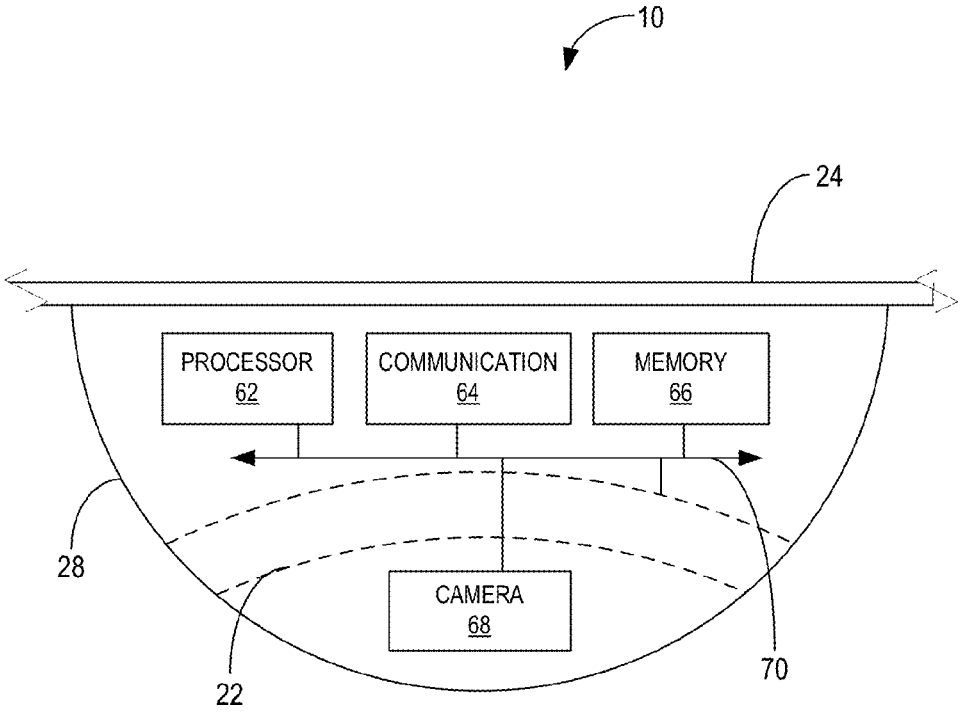
FIG. 11 is a block diagram of an RFID reader with a rotating-polarization reflector-backed RFID loop antenna in accordance with some embodiments.

FIG. 11 is a block diagram of the RFID reader 10 with the rotating-polarization reflector-backed RFID loop antenna 20 in an exemplary embodiment. In general, the RFID reader 10 is configured to provide communication between the RFID reader 10 and RFID tags. For example, the RFID reader 10 "interrogates" RFID tags, and receives signals back from the tags in response to the interrogation, the reader 10 is sometimes termed as "reader interrogator" or simply "interrogator". In an exemplary embodiment, the RFID reader 10 may include, without limitation: a processor 62, a communication module 64, memory 66, a camera 68, and the antenna 20 (through the loop element 22 and the reflector 24). While illustrated in front of the reflector 24, the components 62, 64, 66 may be disposed or located behind the reflector 24 as described herein. The elements of the RFID reader 10 may be interconnected together using a bus 70 or another suitable interconnection arrangement that facilitates communication between the various elements of RFID reader 10. It should be appreciated that FIG. 11 depicts the RFID reader 10 in an oversimplified manner and a practical embodiment can include additional components and suitably configured processing logic to support known or conventional operating features that are not described in detail herein.

The processor 62 may be any microprocessor, application specific integrated circuit (ASIC), field programmable gate array (FPGA), digital signal processor (DSP), any suitable programmable logic device, discrete gate or transistor logic, discrete hardware components, or combinations thereof that has the computing power capable of managing the RFID reader 10. The processor 62 generally provides the software, firmware, processing logic, and/or other components of the RFID reader 10 that enable functionality of the RFID reader 10.

The communication module 64 includes components enabling the RFID reader 10 to communicate on a network, wirelessly, etc. For example, the communication module 64 may include an Ethernet interface to communicate on a local area network. The communication module 64 may further include a transceiver for driving the loop element 22. Additionally, the communication module 64 may include a wireless access point (e.g., based on IEEE 802.11). Additionally, the RFID reader 10 may include other wireless technologies such as, but are not limited to: RF; IrDA; Bluetooth; ZigBee (and other variants of the IEEE 802.15 protocol); IEEE 802.11 (any variation); IEEE 802.16 (WiMAX or any other variation); UMTS; CDMA including all variants; GSM and all variants; TDMA and all variants; Direct Sequence Spread Spectrum; Frequency Hopping Spread Spectrum; wireless/cordless telecommunication protocols; wireless home network communication protocols; paging network protocols; magnetic induction; satellite data communication protocols; wireless hospital or health care facility network protocols such as those operating in the WMTS bands; GPRS; and proprietary wireless data communication protocols such as variants of Wireless USB.

The memory 66 may include any of volatile memory elements (e.g., random access memory (RAM, such as DRAM, SRAM, SDRAM, etc.)), nonvolatile memory elements (e.g., ROM, hard drive, tape, CDROM, etc.), and combinations thereof. Moreover, the memory 66 can incorporate electronic, magnetic, optical, and/or other types of storage media. Note that the memory 66 can have a distributed architecture, where various components are situated remotely from one another, but can be accessed by the processor 62. The memory 66 may be utilized to store data associated with RFID interrogations, the camera 68, etc. The camera 68 may include any device for capturing video, audio, photographs, etc. In an exemplary embodiment, the camera 68 may be disposed within a ring formed by the loop element 22 on the housing 28.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. An antenna apparatus, comprising:

a rotatable loop element comprising a feed; and a reflector backing the loop element and configured to reflect radio frequency energy from the loop element in a direction substantially perpendicular to the reflector;

wherein the rotatable loop element and the reflector cooperatively form a rotating-polarization reflector-backed loop antenna with directionality responsive to a position and/or orientation of the reflector and polarization responsive to a position of the feed on the rotatable loop element.

2. The antenna apparatus of claim 1, wherein the rotatable loop element is configured to rotate by at least 90 degrees thereby providing vertical and horizontal polarization coverage with the rotatable loop element without changing a pattern.

3. The antenna apparatus of claim 1, wherein the rotatable loop element comprises a circumference dimensioned responsive to approximately one full wavelength and the reflector comprises a diameter dimensioned responsive to approximately one full wavelength.

4. The antenna apparatus of claim 1, wherein a pattern formed by the rotating-polarization reflector-backed loop antenna is based on the reflector.

5. The antenna apparatus of claim 1, wherein the rotating-polarization reflector-backed loop antenna is rotated for spatial diversity and the rotatable loop element is rotated without rotating the reflector for polarization diversity.

6. The antenna apparatus of claim 1, further comprising:

a housing comprising the rotatable loop element and disposed to the reflector.

7. The antenna apparatus of claim 6, wherein the housing comprises a substantially dome shape with the rotatable loop element formed on, disposed to, or attached on the dome shape.

8. The antenna apparatus of claim 6, wherein the housing is configured to rotate the rotatable loop element thereby providing vertical and horizontal polarization coverage with the rotatable loop element.

9. The antenna apparatus of claim 6, further comprising:

a Radio Frequency Identification (RFID) reader disposed in the housing and communicatively coupled to the rotating-polarization reflector-backed loop antenna.

10. The antenna apparatus of claim 9, further comprising:

a device comprising any of a camera and wireless access point disposed in the housing and located substantially within a center of the rotatable loop element.

11. A Radio Frequency Identification (RFID) reader, comprising:

a housing;

an RFID reader module disposed in the housing; and a rotating-polarization reflector-backed loop antenna communicatively coupled to the RFID reader module;

wherein the RFID reader is configured to operate in an overhead configuration with respect to a plurality of RFID tags based on the rotating-polarization reflector-backed loop antenna.

12. The RFID reader of claim 11, wherein the rotating-polarization reflector-backed loop antenna comprises:

a rotatable loop element comprising a feed; and a reflector backing the loop element and configured to reflect radio frequency energy from the loop element in a direction substantially perpendicular to the reflector;

wherein the rotatable loop element and the reflector cooperatively form the rotating-polarization reflector-backed loop antenna with directionality responsive to a position and/or orientation of the reflector and polarization responsive to a position of the feed on the rotatable loop element.

13. The RFID reader of claim 12, wherein the rotatable loop element is configured to rotate by at least 90 degrees thereby providing vertical and horizontal polarization coverage with the rotatable loop element without changing a pattern.

14. The RFID reader of claim 12, wherein the rotatable loop element comprises a circumference dimensioned responsive to approximately one full wavelength and the reflector comprises a diameter dimensioned responsive to approximately one full wavelength.

15. The RFID reader of claim 12, wherein a pattern formed by the rotating-polarization reflector-backed loop antenna is based on the reflector.

16. The RFID reader of claim 12, wherein the rotating-polarization reflector-backed loop antenna is rotated for spatial diversity and the rotatable loop element is rotated without rotating the reflector for polarization diversity.

17. The RFID reader of claim 12, wherein the housing comprises a substantially dome shape with the rotatable loop element formed on, disposed to, or attached on the dome shape.

18. The RFID reader of claim 12, wherein the housing is configured to rotate the rotatable loop element thereby providing vertical and horizontal polarization coverage with the rotatable loop element.

19. The RFID reader of claim 12, further comprising:

a device comprising any of a camera and wireless access point disposed in the housing and located substantially within a center of the rotatable loop element.

20. A method, comprising:

transmitting radio frequency energy using a loop element with a feed in a first position;

reflecting with a reflector substantially all of the radio frequency transmitted from the loop element in a vertical direction;

rotating the feed while keeping the reflector in a same position to achieve polarization diversity; and rotating the reflector and the loop element with the field cooperatively to achieve spatial diversity.

* * * * *